US008881656B2

(12) United States Patent
Weyand

(10) Patent No.: US 8,881,656 B2
(45) Date of Patent: Nov. 11, 2014

(54) RAIL STABILIZER FOR RAIL TIE REPLACEMENT

(71) Applicant: Good Earth Tools, Inc., Crystal City, MO (US)

(72) Inventor: Matthew Roger Weyand, Crystal City, MO (US)

(73) Assignee: Good Earth Tools, Inc.

( * ) Notice: Subject to any disclaimer, the term of this patent is extended or adjusted under 35 U.S.C. 154(b) by 98 days.

(21) Appl. No.: 13/648,248

(22) Filed: Oct. 9, 2012

(65) Prior Publication Data

US 2014/0096698 A1 Apr. 10, 2014

(51) Int. Cl.

| | |
|---|---|
| ***E01B 29/04*** | (2006.01) |
| ***E01B 29/10*** | (2006.01) |
| ***E01B 29/32*** | (2006.01) |
| ***E01B 31/00*** | (2006.01) |

(52) U.S. Cl.

CPC ..... *E01B 31/00* (2013.01); *E01B 29/04* (2013.01); *E01B 29/10* (2013.01)

USPC ..... 104/2; 104/9

(58) Field of Classification Search

CPC ..... E01B 29/04; E01B 29/10; E01B 29/20; E01B 29/32; E01B 31/00; E01B 2203/10; E01B 2203/16

USPC ..... 104/2, 7.1, 7.2, 9, 13

See application file for complete search history.

(56) References Cited

U.S. PATENT DOCUMENTS

| | | | | |
|---|---|---|---|---|
| 2,478,535 | A * | 8/1949 | Kershaw | 104/7.1 |
| 3,568,604 | A * | 3/1971 | Sauterel | 104/8 |
| 3,698,324 | A * | 10/1972 | Peppin et al. | 104/9 |
| 3,780,664 | A * | 12/1973 | Holley et al. | 104/9 |
| 3,968,752 | A * | 7/1976 | Theurer | 104/7.2 |
| 4,565,133 | A * | 1/1986 | Moore | 104/7.2 |
| 6,089,163 | A * | 7/2000 | Williams | 104/2 |
| 6,595,140 | B1 * | 7/2003 | Madison et al. | 104/16 |
| 7,287,476 | B2 * | 10/2007 | Durbano | 104/2 |

* cited by examiner

*Primary Examiner* — Zachary Kuhfuss
(74) *Attorney, Agent, or Firm* — Gardere Wynne Sewell LLP

(57) ABSTRACT

A stabilizer is disclosed for use in stabilizing and maintaining the spacing between a pair of railway rails during rail tie replacement. The stabilizer comprises a rod having a length and a pair of ends. A pair of rail clamps is carried by the rod, and each clamp is configured to engage one of the rails and secure the rail relative to the rod. An expanding member is carried by the rod and configured to selectively expand along the length of the rod between its ends to engage a structure proximal to the rails, wherein, upon engagement of the rails by the rail clamps and the expanding member with the structure, the rails are maintained in substantially fixed relationship to each other and to the structure, but are free to be moved vertically relative to the structure.

12 Claims, 1 Drawing Sheet

RAIL STABILIZER FOR RAIL TIE REPLACEMENT

TECHNICAL FIELD

The present invention relates to methods and apparatus for stabilizing railway rails during railway repairs. More specifically, the present invention relates to methods and apparatus for maintaining the position of railway rails relative to one another and to an underlying structure while rail ties are being replaced, particularly on railway bridges.

BACKGROUND OF THE INVENTION

Replacement of rail ties is among the most common railroad or railway repairs. It is time- and labor-consuming and if not carefully carried out, runs the risk of damaging the track by moving the rails "out of gage" (too far apart or close together), out of parallel alignment relative to one another and to the rail bed, or bending the rails. Automated equipment exists for replacing rail ties that uses jigs and fixtures to stabilize the rails while old ties are removed and new ties driven in.

Replacement of rail ties is particularly challenging on railway bridges or trestles because the bridge is often the only solid surrounding structure on which workers and equipment can stand. It is expensive and time-consuming to bring in large work gangs and bridge work is a special operation due to its additional safety (fall protection) and structural requirements. n these operations, the need for rail stabilization is particularly acute.

A need exists, therefore, for methods and apparatus for stabilizing railroad track during tie-replacement operations or other rail repair work.

SUMMARY OF THE INVENTION

It is a general object of the present invention to provide a method and apparatus for stabilizing railroad rails during tie replacement on a working bridge or trestle. This and other objects of the present invention are achieved with a stabilizer for use in stabilizing and maintaining the spacing between a pair of railway rails during rail tie replacement. The stabilizer comprises a rod having a length and a pair of ends. A pair of rail clamps is carried by the rod, and each clamp is configured to engage one of the rails and secure the rail relative to the rod. An expanding member is carried by the rod and configured to selectively expand along the length of the rod between its ends to engage a structure proximal to the rails, wherein, upon engagement of the rails by the rail clamps and the expanding member with the structure, the rails are maintained in substantially fixed relationship to each other and to the structure, but are free to be moved vertically relative to the structure.

According to one embodiment of the present invention, the expanding member further comprises a pair of shoes carried by the rod and movable along the length of the rod, each shoe extending transversely from the rod. A scissor mechanism is arranged between the pair of shoes to selectively move the shoes toward and apart from one another.

According to one embodiment of the present invention, the structure is a railway bridge and the shoes engage portions of the railway bridge below the rails.

A method of stabilizing a pair of railway rails on a rail bridge is also disclosed and comprises the steps of maintaining the railway rails at a fixed distance from one another by engaging them with a rod of fixed length corresponding to the fixed distance. Next, the rails are secured in a fixed position relative to the railway bridge by abutting a portion of the railway bridge with an expanding structure rigidly coupled to the rod. Finally, the rails are raised vertically relative to the railway bridge to permit ties to be removed and replaced.

According to one embodiment of the present invention, the engaging step further comprises clamping one end of the rod to each of the pair of railway rails.

According to one embodiment of the present invention, the abutting step further comprises expanding the structure rigidly coupled to the rod into abutment with a portion of the railway bridge below the rails.

DETAILED DESCRIPTION OF THE INVENTION

Figure 1:
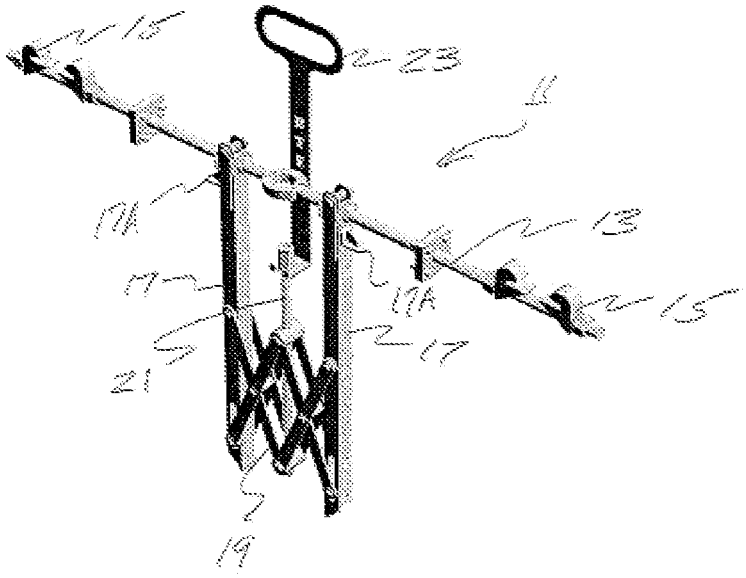
FIG. 1 is a perspective view of the stabilizer apparatus according to the present invention.
Figure 2:
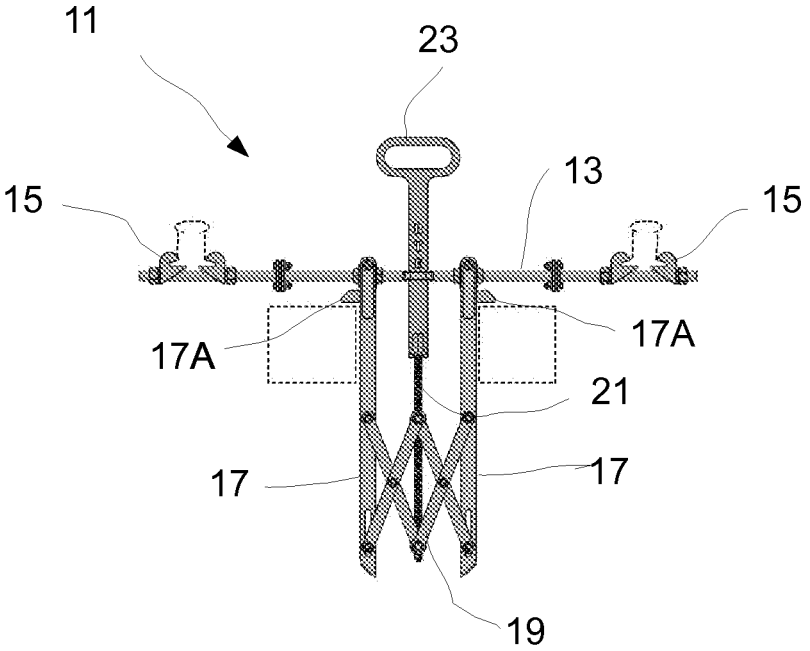
FIG. 2 is an elevation view of the stabilizer apparatus according to the present invention showing the expanded and collapsed positions of the shoes (expanded is in phantom).

Referring now to the Figures and particularly to FIGS. 1 and 2, the rail tie stabilizer 11 according to the present invention will be described. Stabilizer 11 comprises a gage rod 13, which may be a length selected to correspond to the "gage" or width between rails. A pair of rail clamps 15 may be secured by threads and nuts on each end of gage rod 13. Rail clamps 15 are configured to securely and rigidly attach to railroad rails so that, in cooperation with gage rod 13, the rails are maintained spaced apart by the selected gage of the rail track. Rail clamps 15 may be electrically insulated to prevent interference with signals conducted by track.

A pair of shoes 17 may be slidably mounted at their upper ends to gage rod 13. Shoes 17 are movable along the length of gage rod 13 between expanded and collapsed positions and may be mounted to rod 13 using linear bearings and clevis pins for smooth operation and easy disassembly. A scissor mechanism 19 may be arranged between shoes 17 to move them between the expanded and collapsed position. Scissor mechanism 19 preferably is a four link mechanism with each link of equal length and pinned at its ends and middle (there are preferably two identical scissor mechanisms on each side of shoes 17, which doubles the number of links for strength but does not change the mechanical properties of the mechanism). A removable handle 23 may be attached to screw 21 to lift stabilizer 11 and the rails clamped to it for rail tie replacement.

Scissor mechanism 19 may be actuated by turning a lead screw 21, which is coupled to the center joints of the mechanism by nuts. Thus, rotation of lead screw 21 expands and contracts scissors 19 and, in turn, shoes 17. An L-shaped stop 17A is located on each shoe 17 just below gage rod 13 to prevent structures from contacting and damaging rod 13. According to a preferred embodiment of the invention, in the expanded or fully open position, shoes 17 are 28.13 inches apart (measured at outer edge), and in the contracted or fully closed position, shoes 17 are 9.88 inches apart. Mechanisms other than scissors may be useful to expand and contract shoes 17.

In operation, stabilizer 11 is placed on the rail bed with clamps 15 adjacent each rail. Clamps 15 then are engaged with and secured to the rails with shoes 17 extending downwardly between the support structure underneath the rail bed, which is usually a pair of spaced-apart wooden, concrete, or steel beams. Screw 21 may then be rotated to expand scissor mechanism 19 and shoes 17, until they are firmly engaged with and abutting the support structure. At that point, gage rod 13 and clamps 15 maintain the rails in their spaced-apart relationship at a distance corresponding to the railroad gage. Engagement and abutment between shoes 17 and the support structure maintains the rails in a fixed lateral relationship relative to the rail bed (avoiding lateral movement and potential bending). However, stabilizer 11 and the rails secured to it are free to move vertically relative to the railway bridge or rail bed, allowing them to be lifted. With the rails so stabilized, the rails may be lifted using grab hook 23 and stabilizer 11 as a lift point. The rail ties can be driven out and replaced. In most cases, several stabilizers 11 are used along the length of the bridge or trestle to stabilize the rails at multiple points along their length.

The stabilizer according to the present invention offers the ability to stabilize railroad rails during rail tie replacement and other operations on bridges and trestles. The stabilizer may be placed while the track remains in operation, permitting later use to remove and replace ties.

The invention has been described with reference to preferred embodiments thereof, it is thus not limited, but is susceptible to variation and modification without departing from the scope and spirit of the invention.

The invention claimed is:

1. A stabilizer for use in stabilizing and maintaining the spacing between a pair of railway rails during rail tie replacement, the stabilizer comprising:

a rod having a length and a pair of ends;

a pair of rail clamps carried by the rod, each clamp configured to engage one of the rails and secure the rail relative to the rod; and an expanding member carried by the rod and configured to selectively expand along the length of the rod to engage a pair of spaced-apart support beams supporting the rails, wherein, upon engagement of the rails by the rail clamps and the expanding member with the pair of support beams, the rails are maintained in substantially fixed relationship to each other and maintained in alignment with the pair of support beams, but are free to be moved vertically relative to the pair of support beams.

2. The stabilizer according to claim 1 wherein the expanding member further comprises:

a pair of shoes carried by the rod and movable along the length of the rod, each shoe extending transversely from the rod; and a scissor mechanism between the pair of shoes to selectively move the shoes toward and apart from one another.

3. The stabilizer according to claim 1, wherein the pair of support beams is part of a railway bridge.

4. An apparatus for stabilizing railway rails on a railway bridge during rail tie replacement, the apparatus comprising:

a gage rod having a rail clamp proximate each end, each rail clamp configured to releasably secure one of the rails to the gage rod;

a pair of shoes carried by the gage rod and movable along a length of the gage rod, each shoe extending transversely from the gage rod;

a scissor mechanism carried between the shoes and selectively actuable to move the shoes along the length of the gage rod into and out of abutment with a portion of the railway bridge, wherein upon engagement of the railway rails with the rail clamps and abutment of the shoes with the portion of the railway bridge, the railway rails are maintained in a substantially fixed relationship to one another and maintained in alignment with the railway bridge, but are free to move vertically relative to the railway bridge.

5. The apparatus according to claim 4, wherein the scissor mechanism is actuated by a screw carried by and turned from the gage rod.

6. The apparatus according to claim 4 wherein the portion of the railway bridge is a pair of spaced-apart support beams.

7. A stabilizer for stabilizing a pair of railway rails on a railway bridge during rail tie replacement, the stabilizer comprising:

a gage rod;

a rail clamp secured at each end of the gage rod and configured to releasably secure the gage rod to each of the pair of railway rails;

a pair of shoes carried by and extending transversely from the gage rod, the shoes being movable along the length of the gage rod;

a scissor mechanism between the shoes to induce movement of the shoes along the length of the gage rod, wherein the distance between the shoes is expanded or contracted;

a screw carried by the gage rod and coupled to the scissor mechanism to actuate the scissor mechanism in response to rotation of the screw, wherein, upon engagement of the rail clamps on the rails, the screw may be rotated to actuate the scissor mechanism to move the shoes into abutment with portions of the railway bridge to secure the rails in a substantially fixed position with respect to one another, the rails being vertically movable relative to the railway bridge while alignment between the rails and the railway bridge is maintained.

8. The stabilizer according to claim 7 wherein the portions of the railway bridge are a pair of spaced-apart support beams.

9. A method of stabilizing a pair of railway rails on a railway bridge comprising the steps of:

maintaining the railway rails at a fixed distance from one another by engaging them with a rod of fixed length corresponding to the fixed distance;

abutting a portion of the railway bridge with an expanding structure rigidly coupled to the rod to maintain alignment between the railway rails and the railway bridge; and raising the rails vertically relative to the railway bridge.

10. The method according to claim 9, wherein the engaging step further comprises:

clamping the rod to each of the pair of railway rails.

11. The method according to claim 9, wherein the abutting step further comprises:

expanding the structure rigidly coupled to the rod into abutment with a portion of the railway bridge below the rails.

12. The method according to claim 9 wherein the portion of the railway bridge is a pair of spaced-apart support beams.

* * * * *